US007281674B2

(12) United States Patent
Bougamont et al.

(10) Patent No.: US 7,281,674 B2
(45) Date of Patent: Oct. 16, 2007

(54) SPRAYER PUSH-BUTTON

(75) Inventors: Jean-Louis Bougamont, Eu (FR); Jean-Pierre Songbe, Saint Pierre En Val (FR); Herve Imenez, Saint Valerie sur Somme (FR)

(73) Assignee: Rexam Dispensing Systems S.A.S. (FR)

( * ) Notice: Subject to any disclaimer, the term of this patent is extended or adjusted under 35 U.S.C. 154(b) by 0 days.

(21) Appl. No.: 11/247,901

(22) Filed: Oct. 11, 2005

(65) Prior Publication Data

US 2006/0086828 A1 Apr. 27, 2006

Related U.S. Application Data

(63) Continuation of application No. PCT/EP2004/003801, filed on Apr. 8, 2004.

(30) Foreign Application Priority Data

Apr. 9, 2003 (FR) ..... 03 04418

(51) Int. Cl.
*B05B 1/34* (2006.01)

(52) U.S. Cl. ..... 239/468; 239/333; 239/463; 239/468; 239/473; 239/490; 239/492

(58) Field of Classification Search ..... 222/402.1; 239/463, 468, 490–497, 579, 476, 333
See application file for complete search history.

(56) References Cited

U.S. PATENT DOCUMENTS

| | | | | |
|---|---|---|---|---|
| 3,075,708 A | | 1/1963 | Cooprider | 239/490 |
| 3,112,074 A | * | 11/1963 | Green | 239/493 |
| 3,319,894 A | | 5/1967 | Cooprider | 239/490 |
| 3,652,018 A | * | 3/1972 | Focht | 239/490 |
| 3,942,725 A | * | 3/1976 | Green | 239/468 |

FOREIGN PATENT DOCUMENTS

FR 2 095 836 2/1972

OTHER PUBLICATIONS

International Search Report, Jul. 22, 2004, 2 pages.

* cited by examiner

*Primary Examiner*—Kevin Shaver
*Assistant Examiner*—Jason Boeckmann
(74) *Attorney, Agent, or Firm*—St. Onge Steward Johnston & Reens LLC

(57) ABSTRACT

The push-button is made up of two parts which fit into each other and define between them a whirl chamber, a part of which is formed by a cavity (38) defined inside the outer part on a face of the latter that is tilted in a direction and at a sufficient angle (∝), suitable for making it possible to remove the outer part from the mould "along the axis" without damaging the cavity.

11 Claims, 2 Drawing Sheets

SPRAYER PUSH-BUTTON

This application is a continuation of pending International Patent Application No. PCT/EP2004/003801 filed Apr. 8, 2004 which designates the United States and claims priority of pending French Application No. 0304418 filed Apr. 9, 2003.

FIELD OF THE INVENTION

The invention relates to a sprayer push-button with a lateral spraying outlet and relates, more particularly, to an improvement that makes it possible to simplify the structure of this element and, mainly, to reduce the number of parts that it comprises. The invention also covers all manually activated sprayers provided with a pump comprising such a push-button.

SUMMARY OF THE INVENTION

In the field of manually activated sprayers, it is known to arrange a whirl chamber inside the push-button, directly before the conduit for ejecting the sprayed liquid. This whirl chamber, with a peripheral intake and a lateral outlet communicating with the ejection conduit, has the function of placing the liquid to be expelled by the pump in swirling, rotating circulation just before it is ejected, causing it to spray.

Patent FR 2 095 836 describes a push-button with a lateral spraying outlet, made up mainly of two parts made from a moulded plastic material, an inner part and an outer part that forms a cover, respectively, that are globally coaxial and fitted into each other. The inner part is connected to the end of an outlet tube of the pump. It is simply inserted by force onto the latter in order for the push-button unit to be supported by the pump outlet tube. The latter is mounted in the neck of a bottle that encloses the product to be sprayed.

In this push-button, the whirl chamber is made by moulding a cavity on the inner lateral surface of the outer part by means of an internal mechanism of the outer part using a die mechanism that is necessarily large and expensive, difficult to implement and very cumbersome from the point of view of the rhythm of production. In addition, the size of the mechanism intended for insertion in the said outer part makes it impossible to apply this method for manufacturing smaller push-buttons. The invention provides a solution to this series of problems.

The basic idea of the invention consists of defining the essential elements of the whirl chamber by a cavity moulded on the inner face of the outer part, around the inner orifice in the conduit for ejecting the sprayed liquid, without having to resort to any transversally mobile die mechanism inside the mould, but rather by arranging it so that the removal of the said outer piece from the mould can be carried out "along the axis" without, therefore, damaging the cavity.

More specifically, the invention relates to a sprayer push-button with a lateral spraying outlet of the type that comprises a whirl chamber with a central outlet and a peripheral intake, arranged between two moulded parts that are globally coaxial, an inner part and an outer part respectively, these two parts being fitted into each other, and a cavity that is a part of the said whirl chamber defined inside the said outer part, which comprises, in addition, an ejection conduit that extends through its wall starting at the centre of the said cavity, characterised in that the said two parts comprise faces that are tilted in relation to their shared joining axis, applied against each other, characterised in that the said cavity is made on the tilted face of the said outer part and in that the said tilted faces are oriented in a direction and according to a sufficient angle that is suited for making it possible to remove the said outer part from its mould along the said shared axis without damaging the said cavity.

In practice, the angle ($\propto$) defined above, must be greater than 20°, preferably comprised between 30° and 50°.

Advantageously, the tilted faces of the two parts are tapered, which makes all indexing unnecessary, since the whirl chamber is defined entirely by the cavity made on the inner face of the outer part and by the part of the tapered wall of the outer face of the inner wall that is applied against this cavity.

In order to supply the said whirl chamber, it is possible to provide an annular shoulder at the end of the said inner part, which extends between an end face of this part and the said tapered face, which has the effect of defining, together with the outer part, an annular supply channel. Furthermore, the inner part comprises an axial conduit in which the liquid to be sprayed is forced back by the pump. This axial conduit opens into the centre of the end face of the inner part, and at least one transverse passage is defined between the said end face and the inner face opposite the outer part. This transverse passage extends between the axial conduit and the annular supply chamber. Preferably, it is defined by at least one serration or rib moulded onto the inner part, and extending along the end face of the latter. The transverse passage is thus defined between the two end faces in relation to the outer part and the inner part. Obviously, a comparable arrangement defined on the inner face of the outer part would make it possible to define the transverse passage.

Usually, the inner part forms a kind of support fitted by force onto the end of the outlet tube of the manually activated pump, while the outer part forms a kind of decorative cover that is used to cover the support.

BRIEF DESCRIPTION OF THE DRAWINGS

The invention will be better understood and further advantages will be made clear from the following description of a push-button according to its principle, provided only as an example and made in reference to the appended drawings, in which.

DETAILED DESCRIPTION OF THE INVENTION

Figure 1:
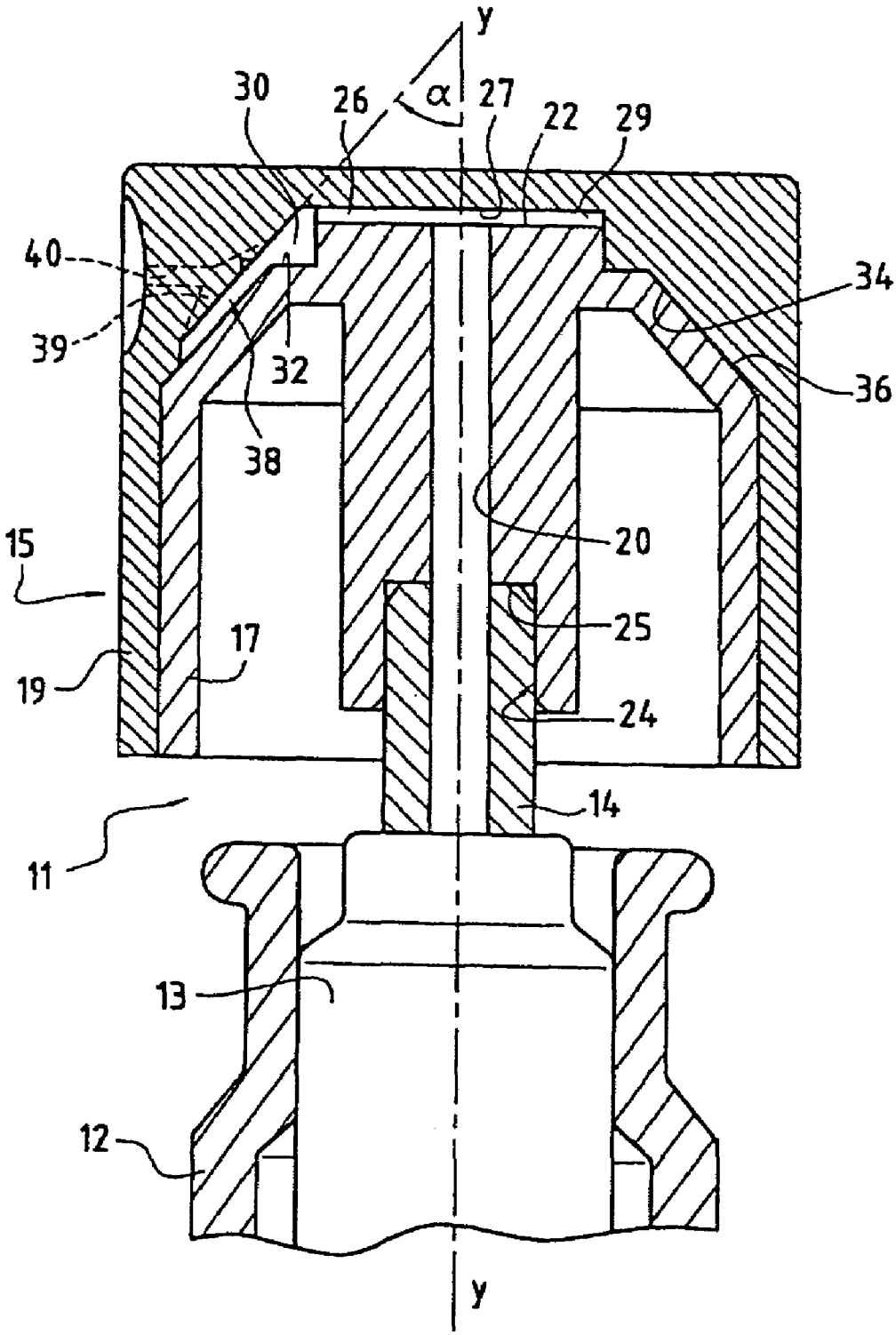
FIG. 1 is an elevated, cross-section view of the push-button mounted on the end of a manually activated pump.

Considering FIG. 1 more particularly, it shows the top of a sprayer 11 comprising a bottle 12, in the neck of which is installed a manually activated pump 13 usually comprising an outlet tube 14 through which the liquid under pressure is expelled when the tube is pushed in by means of a push-button 15, which is installed on the end of this tube.

The push-button 15 comprises only two parts, that is to say, an inner part 17 fitted by force onto the end of the outlet tube 14 and an outer part 19 that covers the inner part and forms a kind of decorative cover. The inner part 17 is the support for the outer part. The two parts are made from a moulded plastic material and are globally coaxial, with their shared axis y-y merging with the axis of the outlet tube 14 when the push-button is installed on the end of the latter. The two parts are fitted into each other along the axis y-y, with no indexing. In the usual manner, the inner part 17 comprises an axial conduit 20 that opens into the centre of an end face 22 of this part, perpendicular to the axis. The end of the axial conduit that is further from this end face comprises a widened section 24, which defines a shoulder 25, suited for receiving the end of the outlet tube 14, mounted through fitting by force. At least one transverse passage is defined between the end face 22 of the inner face and the inner face 27 of the outer part 19. This transverse passage extends between the axial conduit 20 and an annular supply chamber 30 defined between the two parts. More precisely, the inner part comprises an annular shoulder 32 defined in the periphery of the end face 22 and extending along the inner face of the outer part. It is clear that the axial conduit 20 communicates with the transverse passage 26 which opens into the said annular supply chamber 30. Consequently, the liquid pushed back by the pump floods this annular supply chamber.

The end face of the inner part comprises at least one serration or rib 29, which is moulded and defines the transverse passage 26 between the opposing faces 22 and 27.

According to an important characteristic of the invention, the two parts 17, 19 comprise faces 34, 36 that are tilted in relation to their shared axis and applied against each other. The inner tilted face 34 of the outer part 19 has a cavity 38 that defines the main part of a whirl chamber 39. The latter is closed off by the outer tilted face 36 of the inner part 17. The whirl chamber communicates with the said annular supply chamber 30, as can be seen in FIG. 1. Furthermore, an ejection conduit 40 for the sprayed liquid extends through the wall of the outer part 19; it opens on the inside into the centre of the said cavity 38. In the example, the ejection conduit is perpendicular to the shared axis of the two parts; it could also be perpendicular to the tilted face in which the cavity is made. Tilted face means, more precisely, a surface that has a section passing through the shared axis y-y forming an acute angle $\propto$ with this axis, the top of which is outwards and "towards the front" in relation to the end face 22 or 27 perpendicular to this axis. This type of tilt facilitates removing the outer part that comprises the cavity from its mould "along the axis", without damaging the cavity. As mentioned above, the angle $\propto$ has a value of at least approximately 20°, and should preferably be chosen between 30° and 50°.

According to another advantageous characteristic, the tilted faces 34, 36 of the two parts, which are in contact, are tapered, which allows for mounting without indexing.

Figure 2:
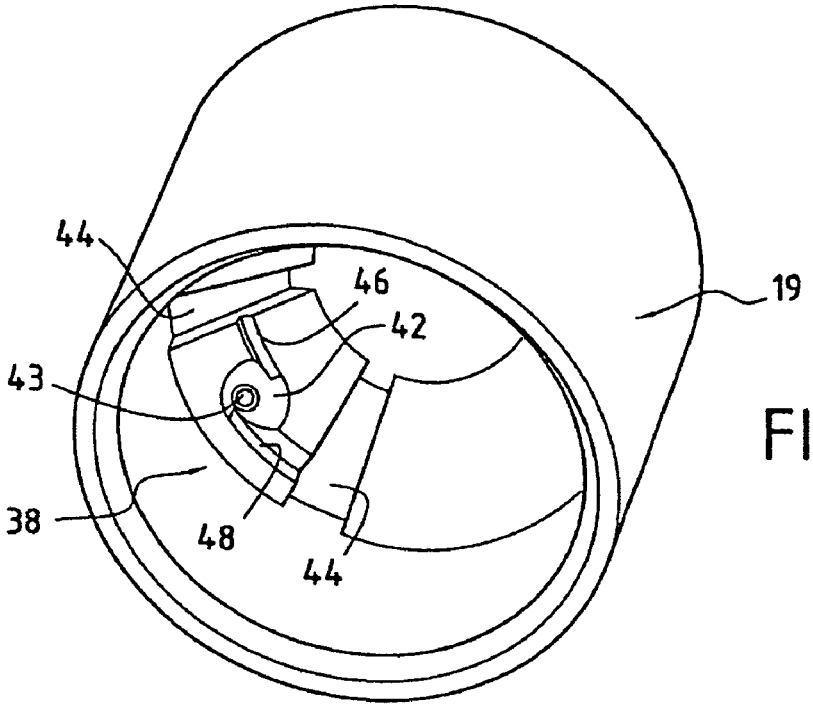
FIG. 2 is a detail perspective view of the inside of the outer part, showing the cavity of the whirl chamber.
Figure 3:
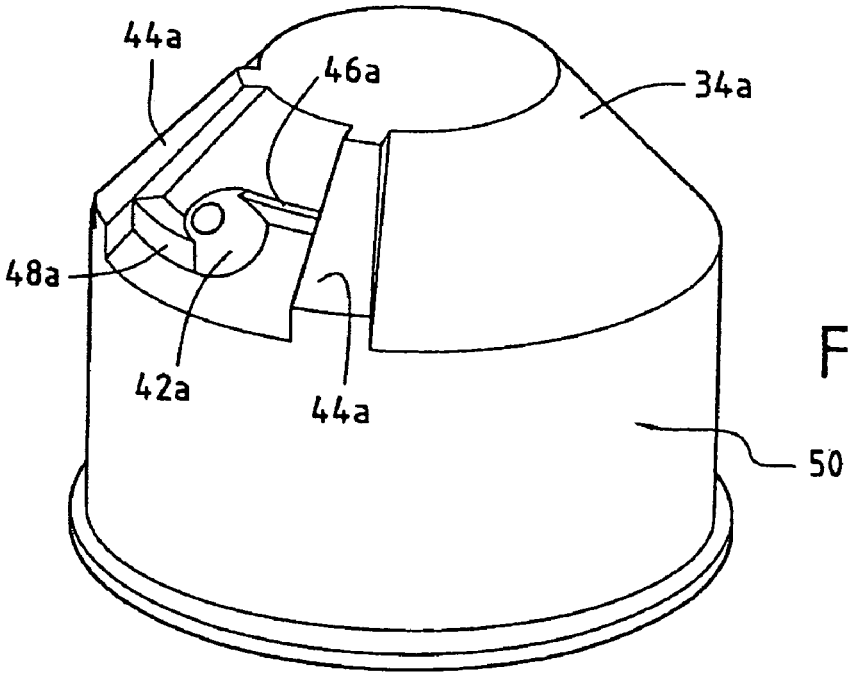
FIG. 3 is a perspective view of one of the elements of the mould of the said outer part.

FIGS. 2 and 3 provide a better understanding of the structure of the cavity 28 and its suitability for being easily removed from the mould "along the axis". In FIG. 2, it can be seen that the cavity comprises a hollow with a circular outline 42, concave or tapered, centred on the inner orifice 43 of the ejection conduit 40, with two grooves 44 extending substantially parallel to a profiling plate of the tapered surface 34, on either side of the said hollow section, and two channels 46, 48 extending respectively between the said hollow section and each groove 44. The two grooves 44 communicate with the annular supply chamber 30 and each channel 46, 48 opens substantially tangentially into the hollow section at points that are substantially diametrically opposed. Furthermore, each channel 46, 48 comprises two sides with a V-shaped cross-section. In the example, the angle of the sides is 90°. One of the sides extends substantially perpendicular to the shared axis y-y, while the other extends substantially along a cylindrical surface that centres on this axis. In the case that the conduit is, as shown here, perpendicular to the shared axis y-y of the two parts, the channel 48 that is further from the annular chamber 30 has a larger gauge than the other channel 46. This gauge difference makes it possible to regain a balance in the whirl of the liquid in the chamber 39 even though the outlet conduit 40 is not "perpendicular" to the said chamber since it is, on the contrary, perpendicular to the axis y-y.

FIG. 3 shows, more particularly, the element 50 of the mould, with the structure elements that are intended to create the cavity 38 embossed. It is possible to distinguish two ribs 44*a* that are intended to form the grooves and extend in a raised pattern across a tapered surface 34*a* on either side of a tapered projection 42*a* that is intended to form the hollow section 42. Two ribs 46*a*, 48*a* that are intended to form the channels 46, 48 extend between this tapered projection and the ribs 44*a*. Obviously, the rib 48*a* has a larger gauge than the rib 46*a*.

What is claimed is:

1. A push-button of a sprayer with a lateral spraying outlet, said push-button comprising:

a moulded outer part having a longitudinal axis and a tilted inner face angled in relation to the longitudinal axis of the outer part, the tilted inner face of said outer part having a cavity formed therein and having an ejection conduit that extends through a wall of said outer part from a centre of the cavity;

a moulded inner part having a longitudinal axis and a tilted outer face angled in relation to the longitudinal axis of the inner part, said inner part being fitted within said outer part such that said outer part and said inner part are coaxial, and such that the tilted inner face of said outer part and the tilted outer face of said inner part are applied against one another;

wherein the tilted inner face of said outer part, the cavity formed in the tilted inner face of said outer part and the tilted outer face of said inner part at least partially define a whirl chamber with a peripheral intake and a central outlet in fluid communication with the ejection conduit;

wherein the tilted inner face of said outer part and the tilted outer face of said inner part are oriented in a direction and at a sufficient angle so that said outer part is removable from a mould used to form said outer part along the longitudinal axis of said outer part without damaging the cavity formed in the tilted inner face of said outer part; and wherein the cavity formed in the tilted inner face of said outer part comprises:

a hollow section with a circular outline centred on the ejection conduit;

two grooves, each of the grooves extending longitudinally within a plane substantially parallel to the longitudinal axis of said outer part and along the tilted inner face of said outer part, with one groove disposed on either side of the hollow section; and channels extending annularly respectively between the hollow section and each groove, and opening substantially tangentially into the hollow section, each channel comprising two sides defining a V-shaped cross-section, one of the sides of each channel extending substantially perpendicular to the longitudinal axis of said outer part and the other of the sides of each channel extending substantially along a cylindrical surface centred on the longitudinal axis of said outer part.

2. A push-button according to claim 1, wherein the tilted inner face of said outer part and the tilted outer face of said inner part are tapered.

3. A push-button according to claim 2, wherein said inner part comprises an annular shoulder which defines, together with said outer part, an annular supply chamber which extends in the periphery of an end face of said inner part and communicates with the whirl chamber.

4. A push-button according to claim 3, wherein said inner part comprises an axial conduit that opens into the centre of the end face of said inner part and wherein at least one transverse passage is defined between said outer part, the transverse passage extending between the axial conduit and the annular supply chamber.

5. A push-button according to claim 4, wherein the end face of said inner part comprises at least one moulded serration or rib which at least partially defines the transverse passage.

6. A push-button according to claim 4, wherein an end of the axial conduit that is further from the end face of said inner part comprises a widened section that is suited for receiving an end of an outlet tube of a pump mechanism.

7. A push-button according to claim 3, wherein a one of the channels that is further from the annular supply chamber has a larger gauge than the other one of the channels.

8. A push-button according to claim 1 wherein the ejection conduit is perpendicular to the longitudinal axis of said outer part.

9. A push-button according to claim 1, wherein the angle between the tilted inner face and the longitudinal axis of the outer part and between the tilted outer face and the longitudinal axis of the inner part is greater than 20°.

10. A push-button according to claim 9, wherein the angle between the tilted inner face and the longitudinal axis of the outer part and between the tilted outer face and the longitudinal axis of the inner part is between 30° and 50°.

11. A sprayer comprising a manually activated pump and a push-button according to claim 1.

* * * * *